US005791818A

United States Patent [19]

Ng

[11] Patent Number: 5,791,818

[45] Date of Patent: Aug. 11, 1998

[54] APPARATUS FOR THE COMBATTING OF UNDERWATER GROWTH ON SUBMERGED STRUCTURES

[75] Inventor: Hock Loo Ng, Cheras, Malaysia

[73] Assignees: Impact Surge Sdn. Bhd., Kuala Lumpur; Petronas Research & Scientific Services, Selangor, both of Malaysia

[21] Appl. No.: 681,098

[22] Filed: Jul. 22, 1996

[30] Foreign Application Priority Data

Jul. 25, 1995 [MY] Malaysia ..... PI 9502118

[51] Int. Cl.[6] ..... F02D 5/60

[52] U.S. Cl. ..... 405/211

[58] Field of Search ..... 405/211, 211.1, 405/213, 216, 195

[56] References Cited

U.S. PATENT DOCUMENTS

| | | | |
|---|---|---|---|
| 1,134,881 | 4/1915 | Lockwood | 405/211 |
| 1,266,050 | 5/1918 | Reynolds | 405/211 |
| 1,266,051 | 5/1918 | Reynolds | 405/211 |
| 1,279,732 | 9/1918 | Lockwood | 405/211 |
| 4,612,056 | 9/1986 | Gibson | 405/216 X |
| 4,676,692 | 6/1987 | Henderson | 405/211 |
| 5,026,212 | 6/1991 | Do | 405/211 |

*Primary Examiner*—Tamara L. Graysay
*Assistant Examiner*—Frederick L. Lagman
*Attorney, Agent, or Firm*—Ladas & Parry

[57] ABSTRACT

An apparatus for the removal or inhibition of underwater growth on an elongate submerged body. It includes at least one collar adapted to extend loosely around the elongate submerged body (28). The collar includes a breaker device to apply impact force on the underwater growth to break it up. The breaker device includes a voluminous body (16) into which ambient water flows in and out. The device can advantageously include rollers (12). The apparatus on a smaller scale can act to inhibit the settlement of new underwater growth.

20 Claims, 7 Drawing Sheets

APPARATUS FOR THE COMBATTING OF UNDERWATER GROWTH ON SUBMERGED STRUCTURES

FIELD OF INVENTION

The present invention relates to apparatus for the combatting of underwater growth on submerged structures, in particular underwater growth in offshore marine structures. More particularly the invention relates to an assembly of apparatus incorporating the use of a device to eliminate marine growth and/or to prevent subsequent establishment of marine growth on submerged offshore marine structures.

BACKGROUND OF INVENTION

The use of apparatus to combat marine growth in offshore marine submerged structures is well known in the prior art. Various attempts have been made to produce practical and cost-effective apparatus to resolve and/or to contain the problem. Examples of such prior art apparatus have been disclosed in U.S. Pat. No. 1,266,050 and U.S. Pat. No. 1,036,907 patents granted to A. L. Reynolds, U.S. Pat No. 1,279,732 patent granted to C. L. Lockwood, U.S. Pat. No. 4,676,692 patent granted to T. H. Clifden and U.S. Pat. No. 5,026,212 patent granted to Christopher N. Do. The prior art apparatus generally adopt elaborate structures to maintain the buoyancy of the apparatus underwater and at the water surface level. For example U.S. Pat. Nos. 1,266,050 and 1,036,907 teach the use of float to provide the buoyancy. Similarly U.S. Pat. No. 1,279,732 also teaches the use of float members ringed together in a collar to provide the buoyancy required to keep the apparatus buoyant.

The use of floats in combination with the true "operative elements" of the prior art apparatus adds to the number of component parts in the assembly, resulting in increase in manufacturing, storage, handling and operational costs.

SUMMARY OF INVENTION

Thus it is an object of the present invention to provide an apparatus for the combatting of underwater growth on submerged structures where the use of structures to solely or substantially solely provide buoyancy for the assembly of apparatus is eliminated or minimized.

The invention consists of an apparatus for the removal or inhibition of underwater growth on an elongate submerged body comprising a collar adapted to extend loosely around the said elongate submerged body. The collar includes a means to apply impact force on the underwater growth. The means comprises a voluminous body into which ambient water flows into when the body is submerged into the water and from which water flows out when the body is removed from the body of the water.

The voluminous body comprises a breaker device with a chamber body for the accommodation of water. Rotatable rollers are secured spaced apart to the voluminous body. Alternatively cylindrical discs can be secured to the voluminous body.

In another aspect, the rotatable rollers can include chambers for the accommodation of water.

In another aspect, the apparatus can include an array of collars stacked vertically and spaced apart. Each collar includes at least one breaker device. The breaker device delivers impact force onto the underwater growth passively in response to ambient water movement.

BRIEF DESCRIPTION OF THE DRAWINGS

Certain preferred embodiments of the present invention will be described by way of example only and with reference to the accompanying drawings in which.

DETAILED DESCRIPTION

Throughout the drawings, the integers are referenced by the same numeral.

Figure 1:
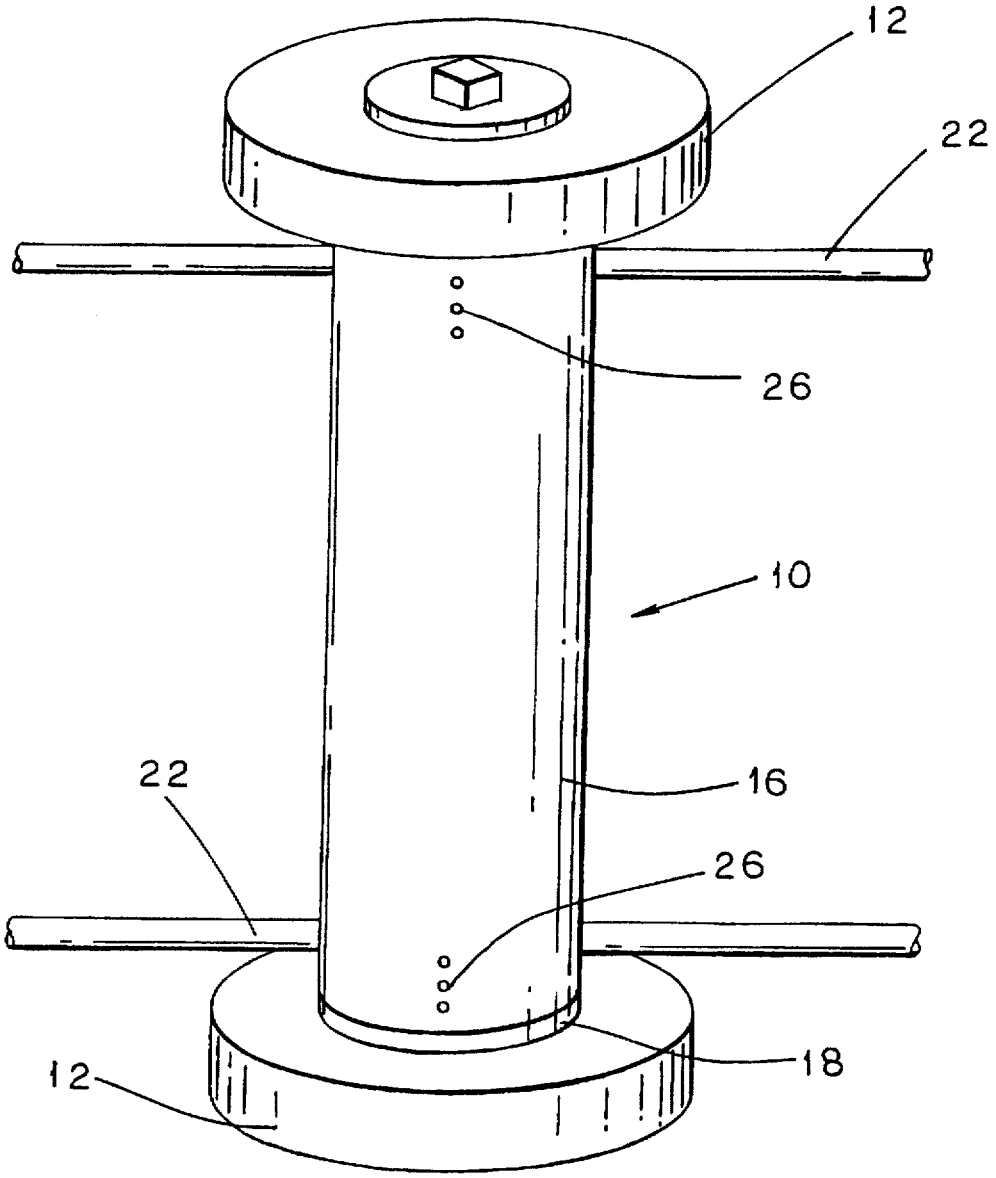
FIG. 1 is a perspective view of a breaker device
Figure 2:
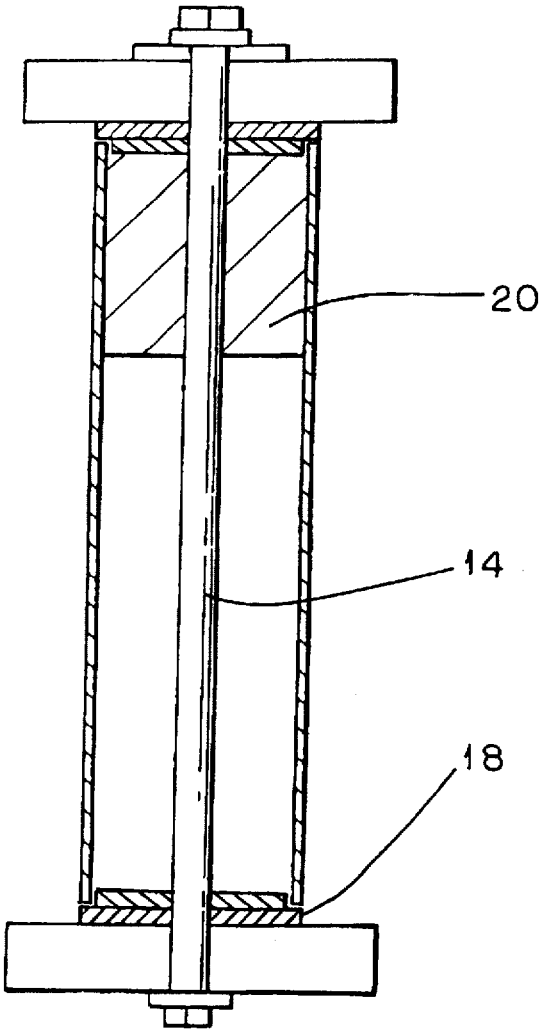
FIG. 2 is a vertical cross-sectional view of the breaker device shown in FIG. 1

A first embodiment of the invention is shown in FIG. 1. The first embodiment includes a pair of breaker rollers (12) connected together by a shaft (14). The breaker rollers (12) are mounted onto the shaft in any conventional manner such that the breaker rollers are rotatable about the shaft (14). Alternatively the rollers can be non-rotatably fixed to the shaft the breaker device (10) includes a cylindrical chamber body (16), positioned between the breaker rollers (12). In the present embodiment the chamber body (16) encloses the shaft (14). The ends of the chamber body (16) are closed with caps (18). The chamber body includes buoyant material (20) such as polystyrene or polyurethane, secured to the upper end of the chamber (16). Alternatively the chamber body can contain a small quantity of free floating buoyant material. Apertures (26) are provided at the top and bottom ends of the chamber.

When the apparatus is made from light material such as plastics, the overall specific gravity of the entire device is less than that ambient water than buoyant material need not be introduced into the chamber body.

Figure 3:
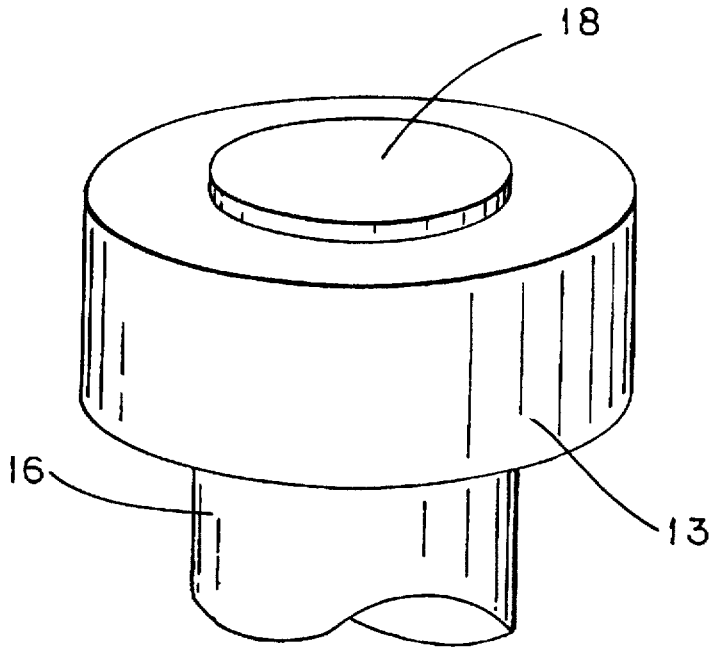
FIG. 3 is a perspective view of an alternate manner in which a disc is attached to the voluminous body

In a variation of the above embodiment, a pair of discs (13) or a pair of rollers (12) can be secured to the ends of the cylindrical chambers instead of to a shaft (see FIG. 3). As before, the terminal ends of the cylindrical chamber body are closed by cap means (18).

The cylindrical chamber body (16) if necessary can contain buoyant material such as polystyrene or polyurethane material or any other suitable non-biodegradable material.

Figure 5:
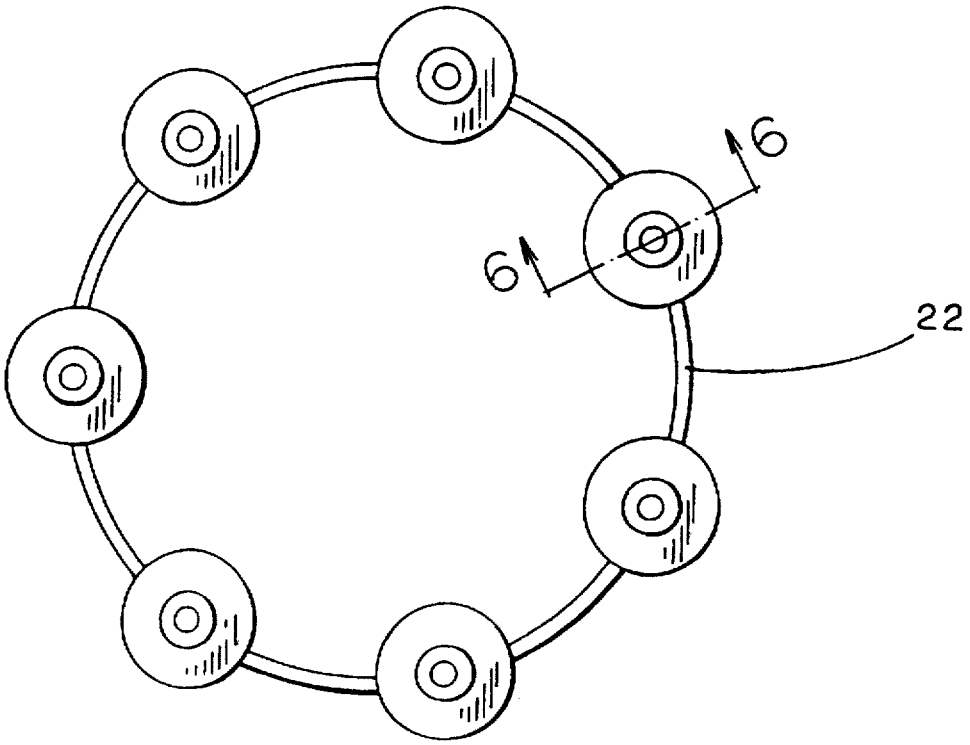
FIG. 5 is a plan view of assembly of breakers rollers ringed to form a collar
Figure 6:
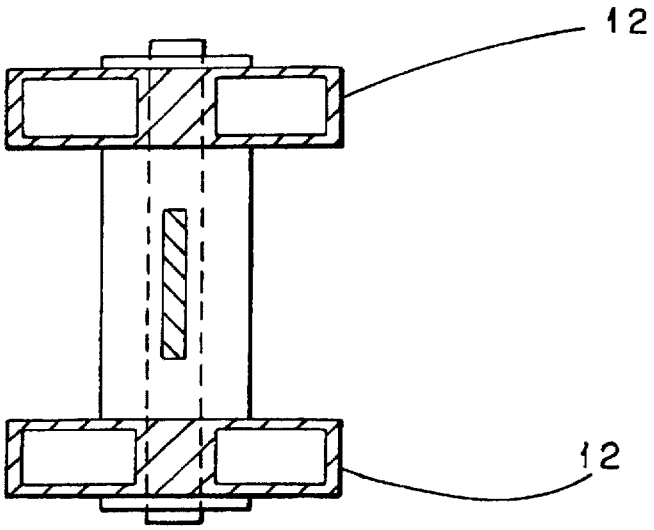
FIG. 6 is a sectional view along line AA in FIG. 5

Referring back to FIG. 1, the chamber body (16) includes at least one aperture (26) each at the lower and upper end of the chamber respectively through which water flows into the chamber. A plurality of pairs of breaker rollers are stringed together to form a collar (22) (see FIG. 5) each pair of breaker roller being spaced apart from the adjacent pair. Any suitable connecting means can be adopted to string together the pairs of breaker rollers. The mode of attachment of the pair of breaker rollers to the connecting means would depend on the nature of connecting means employed. Preferred connecting means are extruded plastics straps, and other long lasting non-biodegradable, non-rusting and flexible material is suitable. Steel cables, ropes or natural fibrous material can be used as connecting means. It is generally advisable to use more lasting, non-deteriorating material to form the connecting means. Appropriate aperture can be provided at the upper and lower end of the chamber body through the connecting means can be stringed to form a ring. Alternatively each pair of breaker rollers can be independently connected to an adjacent pair of breaker rollers.

Figure 9:
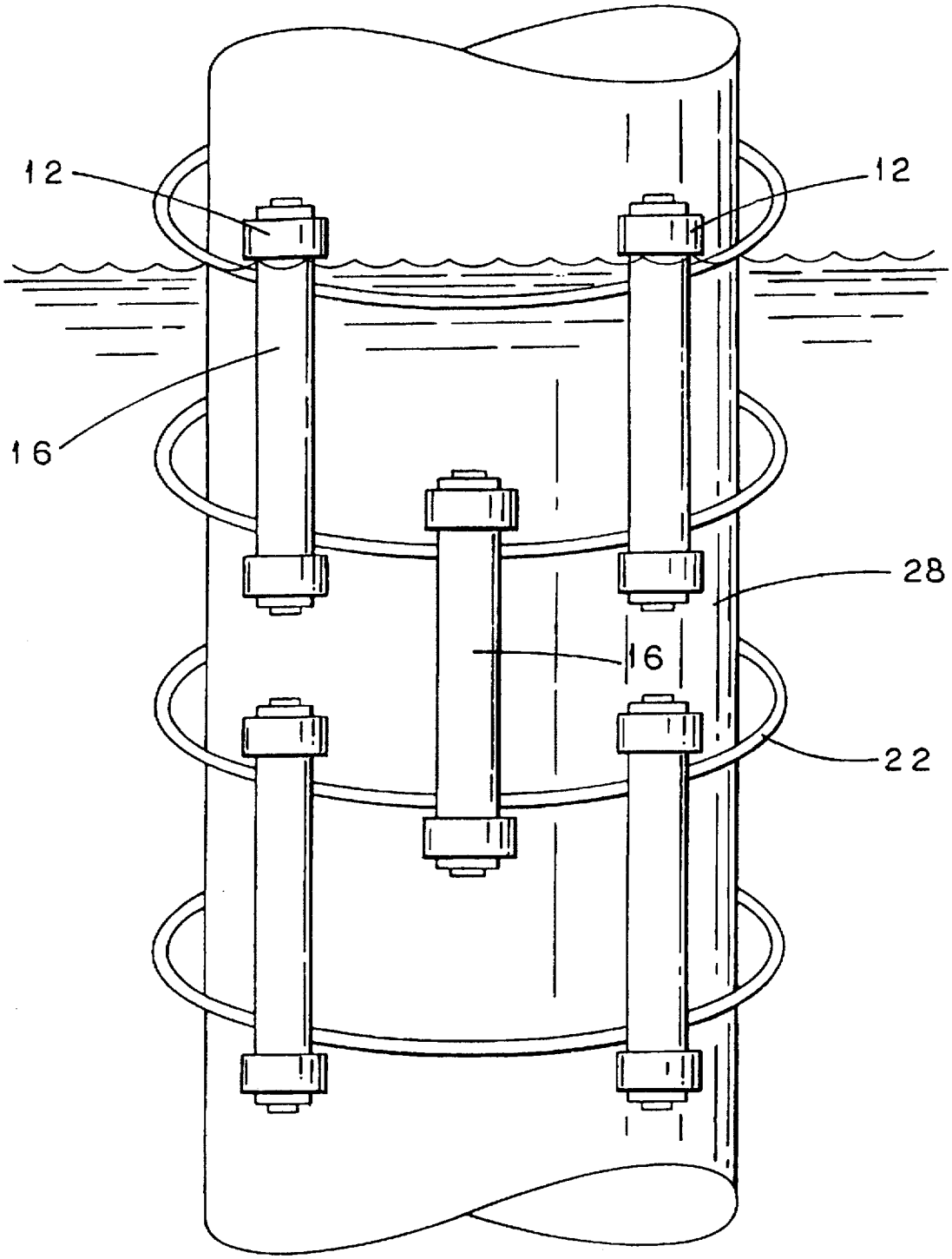
FIG. 9 is a diagrammatic view of an array of collars surrounding a submerged structure

Two sets of collars consisting of a plurality of pairs of breaker rollers can be attached together at, at least two vertically spaced apart positions. If necessary additional sets of collars consisting of pairs of breaker rollers can be attached to form a stacked series of collars. (see FIG. 9)

The working of the apparatus and other additional features of the apparatus will be described now in relation to an offshore tubular support structure as seen often in wharves and in offshore oil exploration rigs. A collar whose length exceeds the circumference of the submerged support structure is prepared. The pairs of breaker roller units are stringed spaced apart in the collar (see FIGS. 5 and 9). The free ends of the collar are secured together by any conventional means known to the art. If the submerged structure is deep, then additional collars with breaker rollers stringed thereon can be linked together in spaced apart vertical stacks to give the required depth (see FIG. 9). When a collar of stringed breaker rollers is introduced into the water, water flows into the cylindrical chamber via the apertures (26) at the lower end of the chamber, displaced atmospheric air from within the chamber escaping out via the apertures at the upper end of the chamber.

Each breaker device (10) filled with water knocks against the side wall of the submerged structure (28), by the force of ambient force originating from wave action, undersea current etc. The swaying action of the collar with the stringed breaker device results in the breaker rollers exerting intermittent hammering force against the aquatic fouling matter on the submerged structure, such as barnacles colonies. As the other collar of stringed breaker devices (12) is not secured to the submerged structure, but is free moving, the collar is free to rotate around the submerged structure.

To produce a more effective hammering action against the fouling matter, the breaker roller (12) can be grooved or geared (see FIG. 3). In environments where there is more calcerous fouling matter to be removed, the external contact surface of the breaker roller with the calcerous fouling matter can be further hardened by the provision of hardened surface material, such as steel or other suitable durable material.

The collars can further include vanes, fins, etc to facilitate the rotational movement of the collars around the submerged structure.

Figure 4:
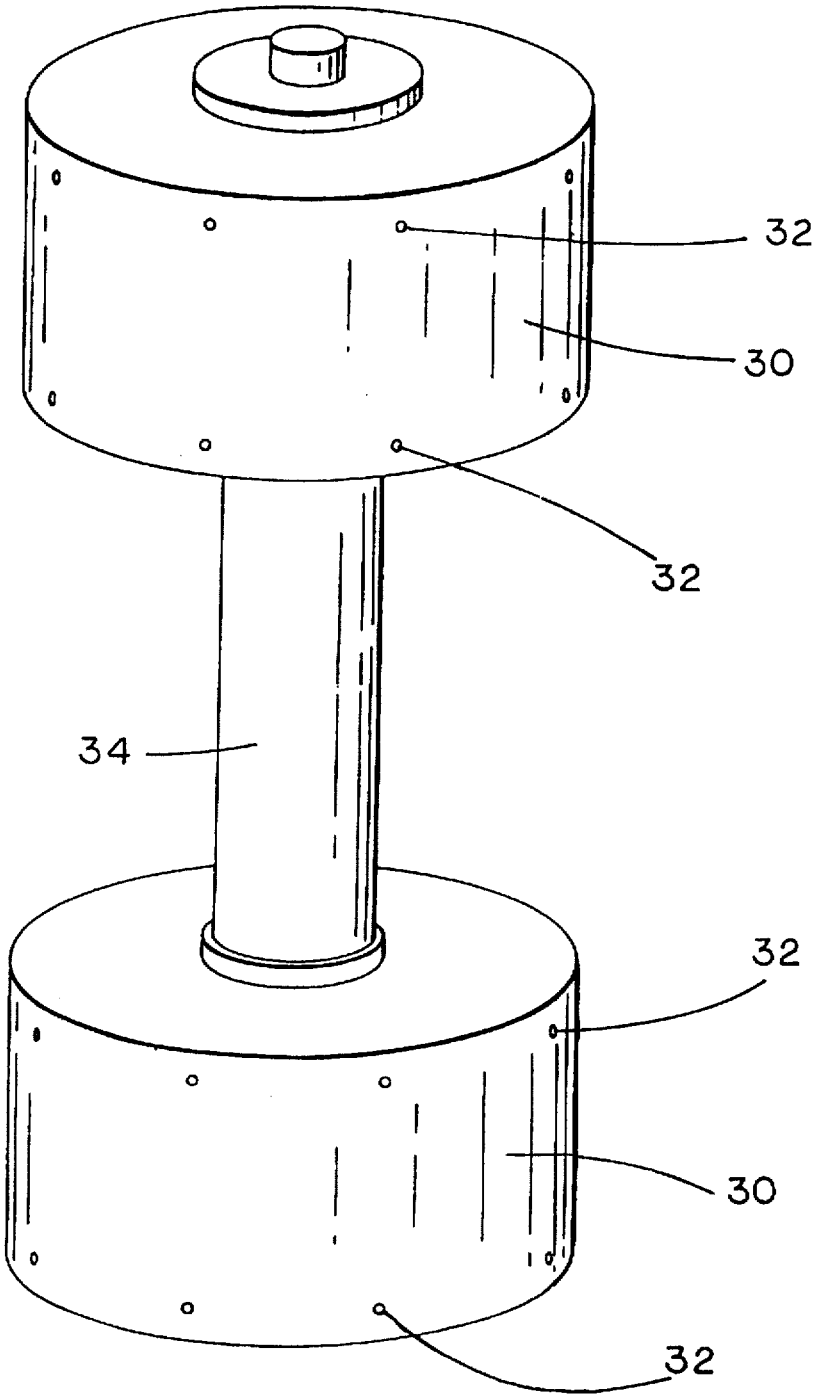
FIG. 4 is a perspective view of a second device embodying the invention

Other embodiments within the scope of the invention concept can be envisaged. FIG. 4 shows another variant of embodiment. The breaker rollers (30) are substantially larger than the breaker rollers shown in FIG. 1. These rollers are hollow and are designed to receive and hold water. Apertures (32) are provided to facilitate the inflow of water. The shaft (34) can be hollow and be designed to receive water as in the shaft (14) of the first embodiment, or alternatively be solid or sealed. The mounting of the breaker rollers (30) onto the shaft (34) can be according to any known means. The breaker rollers (30) are stringed to a collar means by conventional means. Alternatively the rollers (30) can be non-rotatably secured to the shaft (34).

Figure 10:
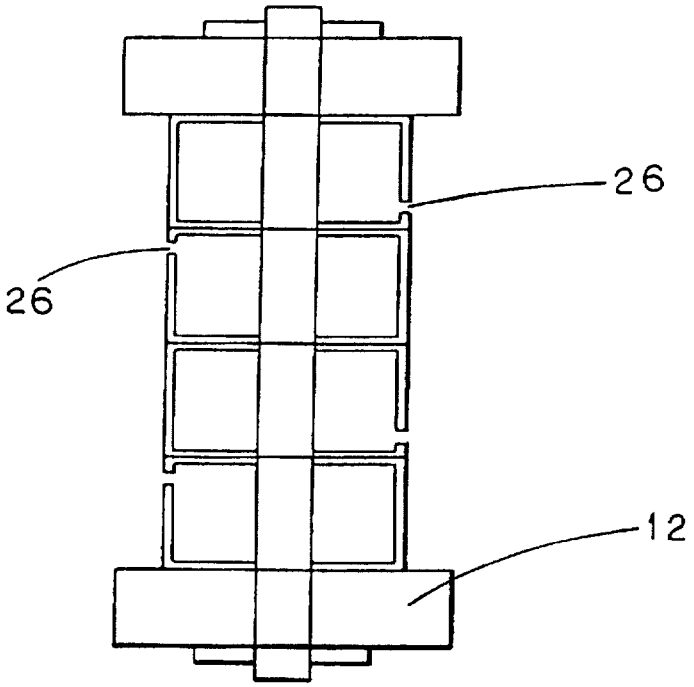
FIG. 10 shows a cross-sectional view of another embodiment
Figure 11:
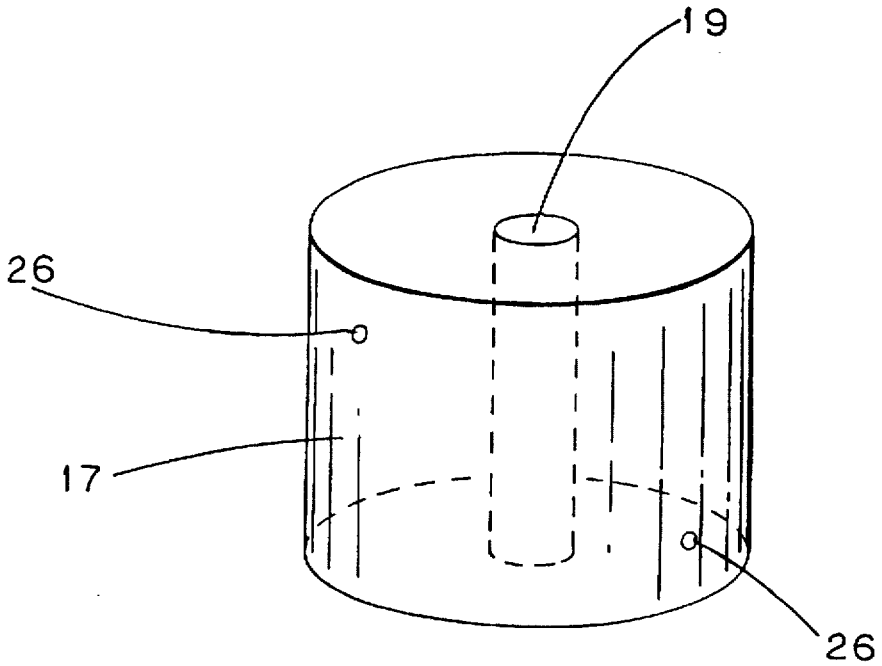
FIG. 11 shows a perspective view of individual unit chamber

FIGS. 10 and 11 illustrate yet another embodiment of the invention. The embodiment is similar to the embodiment illustrated in FIG. 1, except that the cylindrical chamber (16) is replaced with a plurality of individual chambers (17). Each chamber (17) is tubular with a central hole (19) running therethrough, and at least two aperture holes (26) through water enters the chamber and the air is displaced. The chambers are stacked onto the shaft (14). The size of the breaker device can be varied by the addition or subtraction of the number of individual chambers (17) along the shaft (14). The length of the shaft (14) is selected according to the number of chambers that are to be used on a specific configuration of the breaker of the device. It will be appreciated that this configuration permits convenient transportation of the breaker device to the site.

Although each breaker device described so far illustrates the provision a roller at each end of a shaft, it can be envisaged that additional rollers can be provided along the shaft (14, 34) or the rollers can be provided at any place along the shaft and need not be restricted to the terminal ends of the shaft member. Further in a collar of stringed breaker devices, each device can be of different configuration according to the embodiments describes herein.

Figure 7:
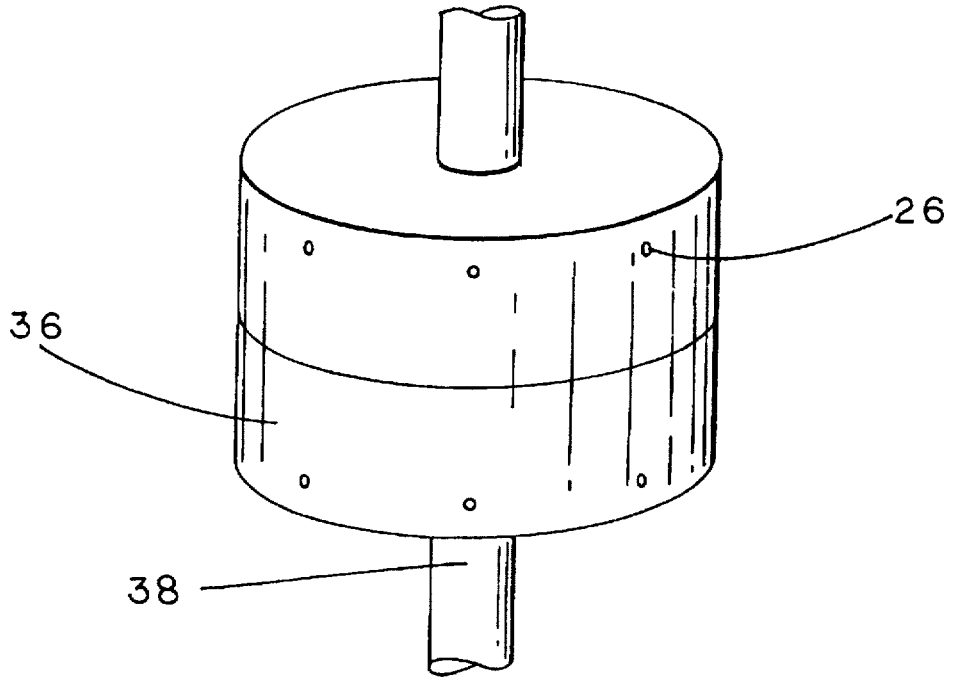
FIG. 7 is a perspective view of a third device embodying the invention
Figure 8:
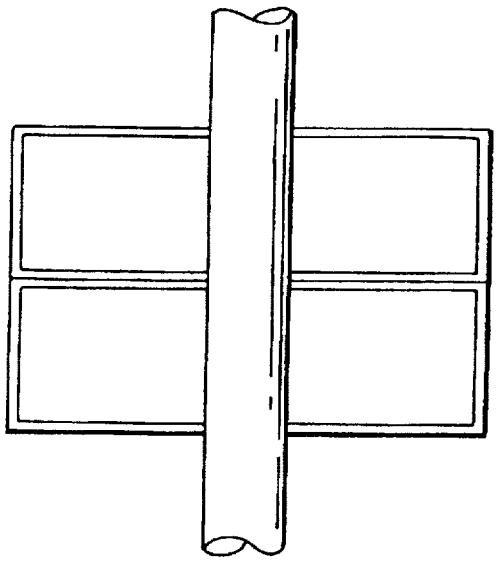
FIG. 8 is a sectional view of the device shown in FIG. 7.

FIGS. 7 and 8 shows yet another embodiment of the invention consisting of a hollow chamber (36) encapsulatingly secured around a shaft member (38). The chamber body (38) includes apertures (26) at the upper and lower ends of the chamber body to facilitate the inflow and outflow of water and the displacement of atmosphere air inside the chamber.

The chamber body can be partially filled with floating material such as polystyrene or polyurethane. As in earlier embodiments of the apparatus, the chamber bodies can be stringed together to form a collar.

When the breaker device is of large dimension, it can be used as a device to eliminate the aquatic foul up. A large sized breaker device exerts greater hammering force on the aquatic foul up material as compared to a smaller size breaker device. Thus once the aquatic foul-up is broken up or eliminated, smaller size breaker device can introduced onto the sub-structures. The smaller size breaker device can function as a device to prevent subsequent growth or establishment of aquatic foul-up material. Other types of preventive device can be used, such as brushes on the collar ring.

The size of a breaker device to be used at a given site would depend on such parameters as nature and size of aquatic foul-up on the submerged structure; the size of natural forces for example, the wave and tide action, underwater currents, etc.

The collars can advantageously include, fins, vanes or other devices to facilitate the rotation of the collar around the submerged elongate body. Further features can be secured to the collar to inhibit the settlement of new underwater growth. The latter features include scrapers and brushes.

I claim:

1. Apparatus for the removal or inhibition of underwater growth on an elongate submerged body comprising a collar adapted to extend loosely around the elongate submerged body and at least one breaker device, said breaker device consisting of a plurality of hollow chambers ringed through a shaft, said hollow chambers having at least two apertures to facilitate the inflow and outflow of liquid and atmospheric air.

2. Apparatus as claimed in claim 1 wherein the chambers include a pair of rollers secured to the shaft.

3. Apparatus as claimed in claim 2, wherein the rollers are rotatable about a common axis.

4. Apparatus for the removal or inhibition of underwater growth on an elongate submerged body comprising a collar adapted to extend loosely around the elongate submerged body and at least one breaker device, the breaker device defining at least one hollow chamber into which liquid is introducible and removable, the breaker device including at least a pair of rollers or discs that are secured spaced apart.

5. An apparatus as claimed in claim 4, wherein the breaker device includes the pair of rollers, the rollers of the pair being secured spaced apart along a central shaft, at least one of the pair of rollers defining said at least one hollow chamber.

6. An apparatus as claimed in claim 5, wherein nonbiodegradable, float material is contained within the at least one hollow chamber.

7. An apparatus as claimed in claim 4, wherein non biodegradable, float material is contained within the at least one hollow chamber.

8. An apparatus as claimed in claim 4, wherein the breaker device includes the pair of rollers, at least one of the pair having an external circumferential surface that is grooved.

9. An apparatus as claimed in claim 4, wherein the breaker device includes the pair of discs.

10. Apparatus for the removal or inhibition of underwater growth on an elongate submerged body, said apparatus comprising a first collar adapted to extend loosely around the elongate submerged body and at least one breaker device, the breaker device defining at least one hollow chamber into which water is introducible and removable, the hollow chamber comprising aperture means for allowing a flow of ambient water into the chamber when the apparatus is introduced into a body of water and for allowing a flow of the ambient water out of the chamber when the apparatus is removed from the body of water.

11. An apparatus as claimed in claim 10, wherein the breaker device comprises roller means including at least one pair of rollers for applying an impact force to the underwater growth.

12. An apparatus as claimed in claim 11, wherein the breaker device includes a chamber body between first and second rollers of said at least one pair of rollers, said chamber body defining said at least one hollow chamber.

13. An apparatus as claimed in claim 11, wherein at least one of the pair of rollers defines said at least one hollow chamber.

14. An apparatus as claimed in claim 13, wherein each of the rollers in the at least one pair of rollers defines a hollow chamber.

15. An apparatus as claimed in claim 11, wherein each of the at least one pair of rollers is rotatable about a common axis.

16. An apparatus as claimed in claim 11, wherein each of the at least one pair of rollers has an external circumferential surface that is adapted to withstand the impact force.

17. An apparatus as claimed in claim 10, wherein the breaker device is of a size and weight sufficient to break the underwater growth when the at least one chamber is filled with water.

18. An apparatus as claimed in claim 10, wherein the breaker device comprises a means for applying an impact force to the underwater growth.

19. An apparatus as claimed in claim 18 comprising at least a second collar adapted to extend loosely around the elongate submerged body, said first and at least second collars forming a stacked array, said at least second collar also being provided with a means for applying an impact force to the underwater growth.

20. An apparatus as claimed in claim 10, wherein the apparatus comprises a float material in the at least one hollow chamber.

* * * * *